United States Patent [19]

Brown

[11] Patent Number: 4,692,668

[45] Date of Patent: Sep. 8, 1987

[54] STROBE ADAPTOR FOR AUTOMOTIVE TIMING LIGHT

[75] Inventor: Francis J. Brown, Chicago, Ill.

[73] Assignee: Deniston Company, Alsip, Ill.

[21] Appl. No.: 516,598

[22] Filed: Jul. 25, 1983

[51] Int. Cl.[4] ..... H05B 37/00

[52] U.S. Cl. ..... 315/241 S; 315/77

[58] Field of Search ..... 315/241 S, 77, 200 A; 324/78 R

[56] References Cited

U.S. PATENT DOCUMENTS

| | | | |
|---|---|---|---|
| 3,144,584 | 8/1964 | La Fiandra et al. | 315/241 S |
| 3,263,126 | 7/1966 | Westberg | 315/241 S |
| 3,543,087 | 11/1970 | Saiger et al. | 315/241 S X |
| 4,369,394 | 1/1983 | Vincent | 315/241 S X |

*Primary Examiner*—David K. Moore

*Attorney, Agent, or Firm*—Kinzer, Plyer, Dorn, McEachran & Jambor

[57] ABSTRACT

A compact adaptor for conversion of a conventional hand-held automotive timing light into a stroboscope for industrial troubleshooting comprises a D.C. power source, preferably a twelve volt rechargeable battery, and an integrated circuit oscillator, both mounted in a housing together with a frequency adjustment circuit to adjust the oscillator frequency over a broad, continuous range. A pair of power terminals engageable by the power cord clamps of the timing light project from the housing, and a load element comprising a part of the oscillator load circuit is mounted outside the housing for engagement by the inductive pickup clamp of the timing light.

12 Claims, 2 Drawing Figures

STROBE ADAPTOR FOR AUTOMOTIVE TIMING LIGHT

BACKGROUND OF THE INVENTION

In any industrial installation utilizing rotating machines or other machinery having continuously moving parts it is often desirable and sometimes virtually essential to develop some technique for effective visual inspection of moving parts of the equipment for setup purposes and for repair and maintenance. That is, inspection of the machinery when shut down may be inadequate to reveal sources of malfunction, whereas an effective visual inspection with the machinery actually in operation may promptly disclose sources of malfunction that could not be determined with the equipment stationary. On the other hand, effective visual inspection of rapidly rotating or moving parts becomes virtually impossible unless maintenance personnel are provided with visual aids that can be synchronized with the high speed movements of the machinery.

In circumstances of this kind, the most effective visual aid for maintenance purposes is often a stroboscope that can be synchronized to the rate of movement of any individual part of the machinery to effectively "arrest" any such part, on a visual basis, and thus allow for effective inspection without shutting down the machinery. But industrial stroboscope equipment suitable for troubleshooting use is usually rather expensive and often requires an external power supply connection that may not be conveniently available in a given industrial installation. Furthermore, conventional stroboscope apparatus is often heavy and bulky so that it is difficult to maneuver into a good viewing position for a specific part of the industrial machinery and may be awkward and tiring for the maintenance or setup mechanic if protracted inspection becomes necessary. Thus, there is a definite need for an inexpensive stroboscope, operable over a broad frequency range to match up with varying speeds for different moving parts in industrial equipment, a stroboscope that is relatively compact and highly portable in nature and that requires no external power line connection.

The conventional automotive timing light, used for timing adjustments of the individual cylinders of an automotive engine, has many of the attributes that are desirable in a stroboscope useful for industrial troubleshooting operations, such as those noted above. Thus, the conventional hand-held automotive timing light affords a light source with adequate output for industrial maintenance and is capable of operation over a relatively broad frequency range. But the automotive timing light has no power source; power is obtained by connection to the battery of the automotive vehicle through a power cord with alligator clamps adapted for connection to the battery terminals. Furthermore, the conventional automotive timing light has no provision for independent frequency control; it includes an inductive pickup clamp that fits around the power lead to the spark plug of the cylinder under adjustment so that the light operates at the actual firing rate for that cylinder. Thus, by itself the conventional automotive timing light cannot be used for the industrial troubleshooting operations referred to above.

SUMMARY OF THE INVENTION

It is a principal object of the present invention, therefore, to provide a new and improved adaptor to convert a conventinal hand-held automotive timing light into an adjustable frequency stroboscope that can be effectively employed for toubleshooting purposes in manufacturing plants and other industrial installations utilizing a variety of machines incorporating rotating or other moving parts, where the operational speeds of the moving parts may vary substantially.

A further object of the invention is to provide an inexpensive adaptor for conversion of a conventional hand-held automotive timing light into an effective troubleshooting stroboscope for industrial equipment, the adaptor being compact in construction and requiring no external power supply connection so that it is fully portable.

Accordingly, the invention relates to a compact strobe adaptor for converting a hand-held automotive timing light into an industrial troubleshooting stroboscope, the timing light being of the kind comprising a light source operable over a broad frequency range, a driver circuit for the light source, an external power cord for energizing the driver circuit that terminates in two terminal clamps connectable to an automotive battery of predetermined voltage, and a pickup cord connected to the drive circuit that terminates in a clamp-type inductive pickup. The strobe adaptor comprises a housing, a D.C. power source of said predetermined voltage, mounted in the housing, an oscillator mounted in the housing and connected to the power source, and a frequency adjustment circuit, connected to the oscillator, for adjusting the operating frequency of the oscillator over a broad range. A pair of power terminals are mounted externally of the housing and connected to the power source, each power terminal having a configuration suitable for engagement by one of the timing light power cord terminal clamps. A load circuit, connected to the oscillator, includes a load element mounted externally of the housing and having a configuration suitable for encompassing engagement by the inductive pickup clamp of the timing light.

DESCRIPTION OF THE PREFERRED EMBODIMENT

Figure 1:
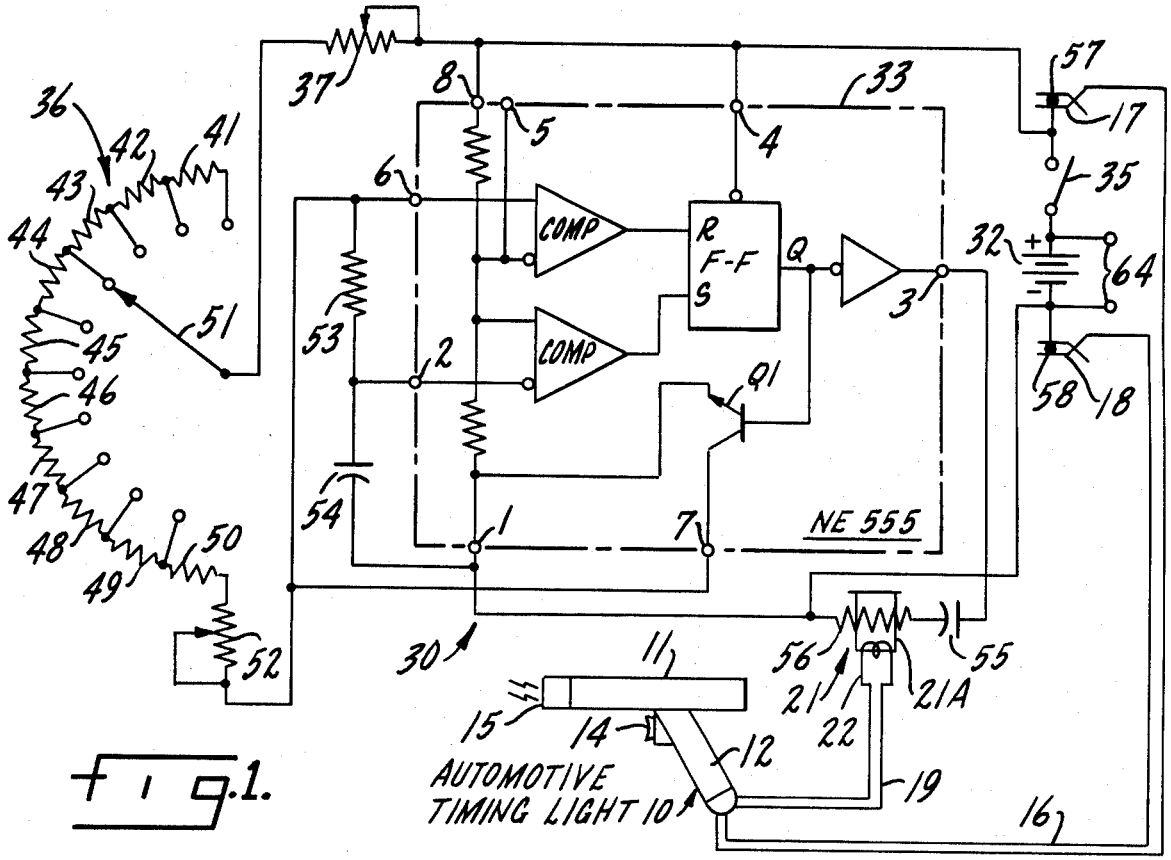
FIG. 1 is a schematic circuit diagram of a strobe adaptor for an automotive timing light, constructed in accordance with a preferred embodiment of the present invention.
Figure 2:
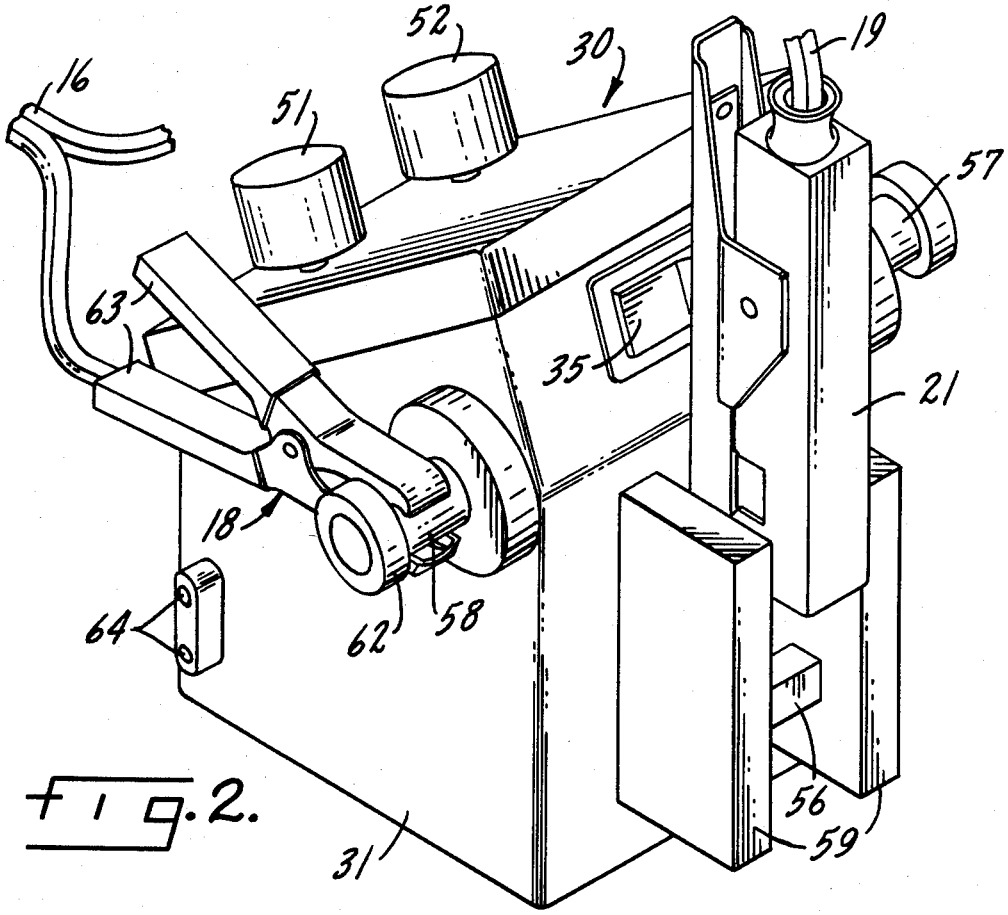
FIG. 2 is a perspective view of the adaptor of FIG. 1, showing the manner in which the adaptor is connected to a conventional hand-held automotive timing light.

FIGS. 1 and 2 illustrate a compact strobe adaptor, constructed in accordance with a preferred embodiment of the present invention, for converting a conventional hand-held automotive timing light into a stroboscope suitable for use in industrial troubleshooting applications. As shown in FIG. 1, a conventional hand-held automotive timing light 10 includes a barrel 11 and a pistol-grip handle 12. The sole operating control for the timing light 10 is a trigger-like actuating switch 14. The light output from the automotive timing light 10 is developed by a light source, generally indicated at 15, energized by a driver circuit mounted in the timing light housing.

The automotive timing light 10 is provided with a two-conductor power cord 16 for energizing the driver circuit (not shown) that actuates light source 15. Power cord 16 terminates in two terminal clamps 17 and 18 adapted for convenient connection to the terminal posts of an automotive battery. Clamps 17 and 18 are usually alligator clamps of the kind illustrated in FIG. 2. The power supply voltage required for timing light 10 is usually twelve volts D.C., since that is the most common automotive battery voltage.

The automotive timing light 10 further comprises a two-conductor pickup cord 19 that supplies actuation signals to the light source driver circuit in the timing light, thus controlling the timing of the operation of light source 15. In a conventional timing light, pickup cord 19 terminates in a clamp-type inductive pickup 21 as shown in FIGS. 1 and 2. The clamp portion of pickup 21 affords a single conductor loop 21A (FIG. 1); the two conductors of cord 19 are connected to the opposite ends of an inductive pickup coil 22 wound on one leg of loop 21A. In the normal use of timing light 10, inductive pickup 21 is clamped around the power lead to one spark plug of an engine so that light source 15 is energized in synchronism with the firing of one cylinder of the engine.

A strobe adaptor 30 constructed in accordance with a preferred embodiment of the present invention is illustrated schematically in FIG. 1 and a perspective view of the adaptor is provided in FIG. 2. Strobe adaptor 30 includes a compact housing 31; housing 31 may be fabricated from sheet metal or a molded resin housing may be used.

As shown in FIG. 1, strobe adaptor 30 includes a D.C. power source, illustrated as a battery 32. In a typical construction, power source 32 may comprise two series-connected six volt nickel-cadmium rechargeable storage batteries, thus affording a power source matching the usual twelve volt power supply requirement of automotive timing light 10. Other types of power source could be used, such as a series of dry cells affording a total output voltage of approximately twelve volts or an AC/DC transformer and rectifier circuit for conversion of an A.C. supply to the requisite twelve volt D.C. supply. However, dry cells are likely to be inordinately expensive in operation of adaptor 30 and an AC/DC conversion circuit is undesirable in that it requires an external power connection that may be inconvenient in many instances.

As shown in FIG. 1, strobe adaptor 30 includes an integrated circuit electronic timer 33; the integrated circuit timer 33 is mounted within housing 31 (FIG. 2). The integrated circuit 33 as illustrated in FIG. 1 is a conventional type NE555 timer, available from several manufacturers, having a ground terminal 1, a trigger input terminal 2, an output terminal 3, a reset terminal 4, a control terminal 5, a threshold input terminal 6, a discharge terminal 7, and a VCC power terminal 8. It should be understood, however, that other integrated circuit timer or oscillator devices may be utilized.

In adaptor 30, FIG. 1, the electronic timer 33 is connected in an oscillator circuit generally similar to but specifically different from the standard oscillator circuit recommended by the manufacturers. Terminals 8 and 4 of the timer are connected together and are connected to the positive terminal of power source 32 through an ON/OFF switch 35. The threshold input terminal 6 of the integrated circuit is connected to its discharge terminal 7 and is also connected to the positive terminal of battery 32 through a frequency adjustment circuit 36 and switch 35. The frequency adjustment circuit 36 includes, in series, a trimmer potentiometer 37 that is mounted within housing 31 (FIG. 2), followed by a series of fixed coarse tuning resistors 41 through 50 selectively connectible into circuit 36 by means of a rotary selector switch 51. The frequency adjustment circuit 36 further includes a fine tuning potentiometer 52 connected in series with resistors 41–50.

In the preferred construction, the coarse tuning resistors 41–50 all have the same resistance value and potentiometer 52 has a maximum resistance that corresponds to the resistance of each coarse tuning resistor. This arrangement allows for coarse selection of a limited frequency range by actuation of selector switch 51, with fine tuning over that limited range by operation of potentiometer 52. Selector switch 51 and potentiometer 52 are both adjustable from the exterior of adaptor housing 31 as shown in FIG. 2.

The oscillator circuit connections for electronic timer 33, FIG. 1, further comprise a resistor 53 connected between the threshold input terminal 6 and the trigger input terminal 2, and a capacitor 54 connected from trigger terminal 2 to ground terminal 1. Ground terminal 1 is connected to the negative terminal of the power source, battery 32. The oscillator further includes a load circuit connected from output terminal 3 to ground terminal 1 of timer 33. This load circuit preferably comprises a capacitor 55 in series with a resistor 56. All of the electronic components for strobe adaptor 30 are mounted within housing 31 (FIG. 2) with the exception of load resistor 56, which extends between two insulator members 59 that project outwardly from the housing and support resistor 56 in spaced relation to the housing where it is adapted to be engaged in encompassing relation by the inductive pickup clamp 21 of automotive timing light 10 as schematically indicated in FIG. 1; in FIG. 2, clamp 21 is shown in a position immediately prior to its installation around load element 56.

Adaptor 30, FIG. 1, includes two power terminals 57 and 58 electrically connected to the positive and negative terminals, respectively, of the power source, battery 32. As shown in FIG. 2, the negative power terminal 58 comprises a conductive post terminal projecting outwardly of housing 31, post 58 having a configuration suitable for engagement by the negative polarity timing light power cord terminal clamp 18. The outer end of terminal post 58 is provided with an insulator cap 62, preferably color-coded black to correspond to the black insulator sleeve 63 customarily employed on the negative terminal clamp of a conventional automotive timing light. A similar construction is utilized for the positive polarity power terminal 57, not shown in FIG. 2, except that the end insulator for the positive power terminal should be color-coded red in accordance with conventional practice. Battery 32 is also preferably provided with charging terminals 64, as shown in FIG. 1, which are accessible externally of housing 31 as shown in FIG. 2.

Setup and operation of the industrial troubleshooting stroboscope formed by the combination of the conventional automotive timing light 10 and the compact, portable strobe adaptor 30 is both simple and convenient. At the outset, the power terminal clamps 17 and 18 of the power cord 16 for timing light 10 are clamped to the color-coded terminal posts 57 and 58 of adaptor 30. This provides the requisite twelve volt power supply for the driver circuit for the light source 15 of timing light 10. To complete the set up, clamp 21 is clamped around load element 56 of adaptor 30 to afford a timing input to device 10. By closing switch 35, the complete stroboscope is made ready for operation.

For industrial troubleshooting and similiar purposes, timing light 10 is aimed at a particular moving part to be inspected. The operating switch 14 of timing light 10 is closed in the usual manner, producing an intermittent flashing output from light source 15 at a frequency determined by the operation of the oscillator formed by the integrated circuit timer 33 and its external circuit connections. The mechanic or other person conducting the inspection adjusts selector switch 51 to approximately the speed of the moving part under inspection, this approximation being indicated visually by an apparent "slowing down" movement of the part. Fine tuning potentiometer 52 is then adjusted until the movement of the part under inspection is visually "arrested". For inspection of another moving part, which may operate at a totally different speed, the only adjustments necessary are effected with selector switch 51 and potentiometer 52.

The entire stroboscope apparatus, consisting of timing light 1 and adaptor 30, is readily portable; the maximum dimension for housing 31 may be of the order of about four inches. Adaptor 30 may be positioned on the floor or on any stationary horizontal surface, the power cord 16 and pickup cord 19 for the conventional timing light 10 allowing complete freedom of movement over a substantial distance from the adaptor, usually six feet or more. No modification of timing light 10 is required; the conventional automotive timing light is used without change. Device 10 can be disconnected from adaptor 30 and again used as a conventional timing light at any time. Conversely, a different timing light can be connected to adaptor 30 at any time a stroboscope is needed.

In comparison with conventional industrial stroboscopes, the cost of the stroboscope 10,30 is greatly reduced because adaptor 30 is relatively inexpensive and timing light 10 is a high volume, low cost, commercially available device. After use of the stroboscope, it is a simple matter to re-charge battery 32 using a conventional, inexpensive automotive battery charger. Adaptor 30 can be utilized with any of a wide variety of commercial available automotive timing light units without modification to fit the timing light of any specific manufacturer. The operating frequency range for the complete stroboscope afforded by timing light 10 and adaptor 30 is quite broad and is limited only by the capabilities of the timing light. For most commercial automotive timing lights, an operating frequency range from below 100 Hz to approximately 4000 Hz is readily achievable. It may be necessary to adjust the trimmer potentiometer 37 to fit the requirements of a specific automotive timing light 10, but even this adjustment is unnecessary in most instances.

The combination stroboscope 10,30 does not provide a readout of operating frequency. It could be provided with a frequency meter, but such a meter would be useless in most troubleshooting applications; the maintenance or setup mechanic does not require a frequency readout.

In a specific embodiment of the invention, the following circuit components may be employed:

Timer IC 33: Type NE555
Potentiometer 37: 1 megohm
Resistors 41–50: 500 kilohms each
Potentiometer 52: 500 kilohms
Resistor 53: 1 kilohm
Capacitor 54: 0.04 microfarad
Capacitor 55: 0.01 microfarad
Resistor 56: 10 ohms (wire wound)

Of course, the foregoing data are provided solely as an example of a specific working embodiment, and in no sense as a limitation on the invention.

I claim:

1. A compact strobe adaptor for converting a hand-held automotive timing light into a portable, compact industrial troubleshooting stroboscope without modification of the timing light, the timing light being of the kind comprising a light source operable over a broad frequency range, a driver circuit for the light source, an external power cord for energizing the driver circuit that terminates in two terminal clamps connectable to the terminals of an automotive battery of predetermined voltage, and a pickup cord connected to the drive circuit that terminates in a clamp-type inductive pickup, the strobe adaptor comprising:

a housing;

a D.C. power source of said predetermined voltage, mounted in the housing;

an oscillator mounted in the housing and connected to the power source;

a frequency adjustment circuit, connected to the oscillator, for adjusting the operating frequency of the oscillator over a broad range;

a pair of power terminals mounted externally on the housing and connected to the power source, each power terminal having a configuration suitable for engagement by one of the timing light power cord terminal clamps;

and a load circuit, connected to the oscillator, including a load element mounted externally on the housing and having a configuration suitable for encompassing engagement by the inductive pickup clamp of the timing light.

2. A strobe adaptor according to claim 1 in which the D.C. power source comprises one or more rechargeable storage batteries.

3. A strobe adaptor according to claim 1 in which the oscillator comprises an integrated circuit timer connected in an oscillator circuit.

4. A strobe adaptor according to claim 1 in which the frequency adjustment circuit comprises a series of fixed coarse tuning resistors, a rotary selector switch for selection of any given number of resistors in the series, and a fine tuning potentiometer connected in series with the fixed resistors.

5. A strobe adaptor according to claim 4 in which the coarse tuning resistors each have a predetermined resistance and the maximum resistance of the fine tuning potentiometer is equal to that predetermined resistance.

6. A strobe adaptor according to claim 1 in which the load element comprises a resistor.

7. A strobe adaptor according to claim 6 in which the load circuit includes a capacitor connected in series with the resistor load element.

8. A strobe adaptor according to claim 6 in which the oscillator comprises an integrated circuit timer connected in an oscillator circuit.

9. A strobe adaptor according to claim 8 in which the frequency adjustment circuit comprises a series of fixed coarse tuning resistors, a rotary selector switch for selection of any given number of resistors in the series, and a fine tuning potentiometer connected in series with the fixed resistors.

10. A strobe adaptor according to claim 9 in which the coarse tuning resistors each have a predetermined resistance and the maximum resistance of the fine tuning potentiometer is equal to that predetermined resistance.

11. A strobe adaptor according to claim 9 in which the load circuit includes a capacitor connected in series with the resistor load element.

12. A strobe adaptor according to claim 11 in which the D.C. power source comprises one or more rechargeable storage batteries and in which the power terminals are color coded in accordance with automotive practice.

* * * * *